United States Patent [19]

Lèbre

[11] Patent Number: 4,458,786

[45] Date of Patent: Jul. 10, 1984

[54] FORK-LIFT TRUCK WITH SYNCHRONIZED VARIABLE TRAVELLING AND LIFTING SURFACES

[76] Inventor: Charles J. P. Lèbre, 35 rue de l'Orangerie, F-91700 Ste Geneviève des Bois, France

[21] Appl. No.: 458,083

[22] Filed: Jan. 14, 1983

Related U.S. Application Data

[63] Continuation of Ser. No. 202,828, Oct. 31, 1980, abandoned.

[30] Foreign Application Priority Data

Nov. 6, 1979 [FR] France ..... 79 27278
Dec. 17, 1979 [FR] France ..... 79 30911

[51] Int. Cl.[3] ..... B66B 9/20

[52] U.S. Cl. ..... 187/9 R; 182/141; 280/35

[58] Field of Search ..... 187/9 R, 9 E; 280/638, 280/659, 35; 211/201; 182/195, 38, 39, 141; 414/444; 74/422, 89.12

[56] References Cited

U.S. PATENT DOCUMENTS 1,390,123 9/1921 Gilkey et al. ..... 280/35
3,448,878 6/1969 Schindler ..... 187/9 R

*Primary Examiner*—Joseph J. Rolla
*Assistant Examiner*—Kenneth Noland
*Attorney, Agent, or Firm*—William A. Drucker

[57] ABSTRACT

The fork-lift truck comprises two elements independent of each other, each element comprising a vertical mast integral with a horizontal side frame provided with wheels and integral with two parallel cross pieces disposed at different heights, the parallel cross pieces of one element being designed to slide inside the corresponding cross pieces of the other element thus allowing the adaptation of the width of the truck to the load to be taken up. On the vertical mast of each element can slide a support for a lifting arm integral with cross pieces, the corresponding cross pieces of the supports of the two truck elements being also designed to slide the one into the other.

5 Claims, 9 Drawing Figures

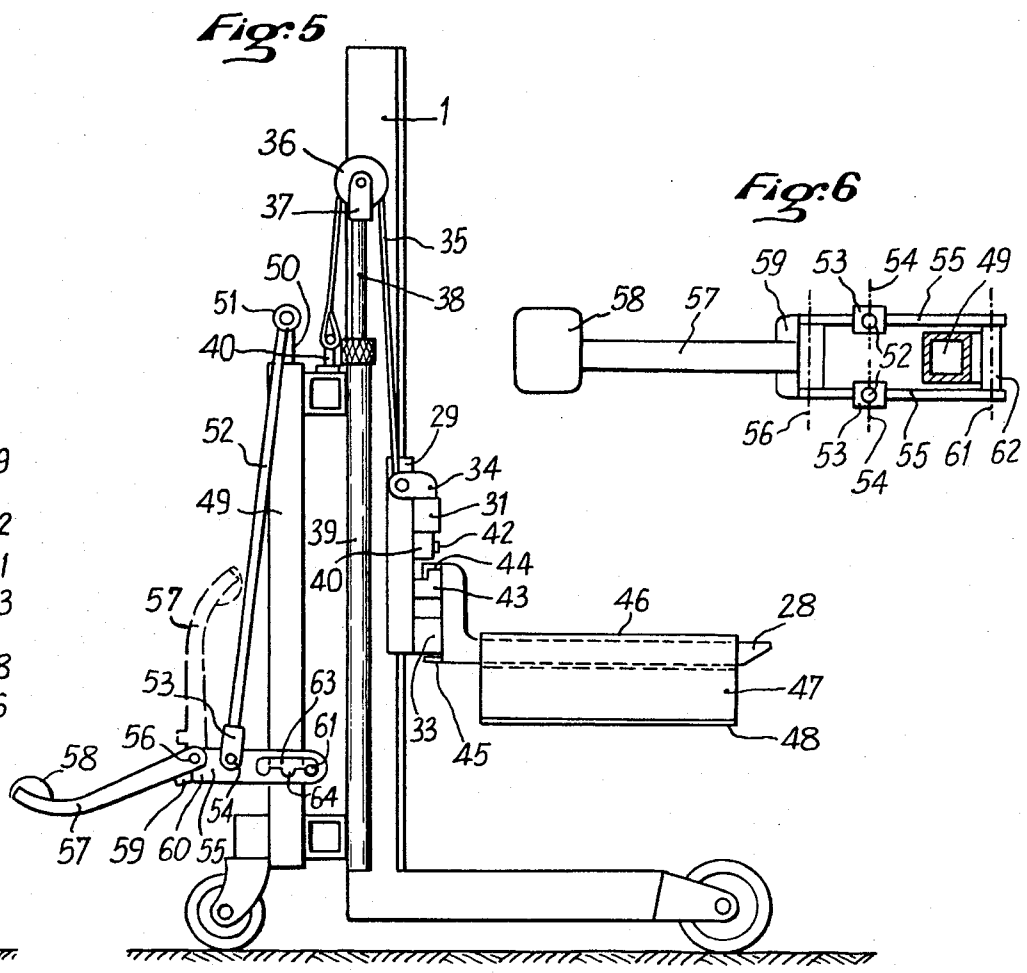
Fig:6
Fig:5
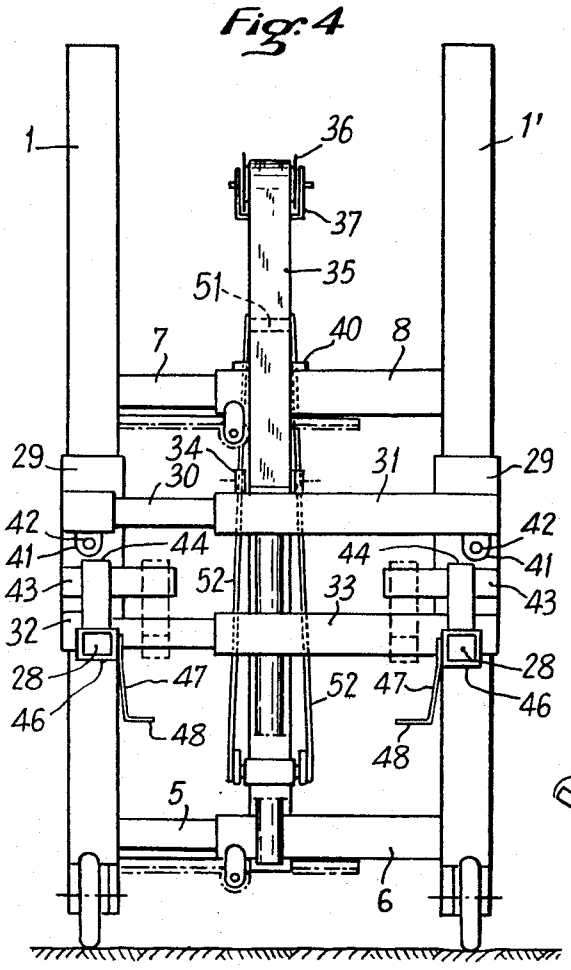
Fig:4

FORK-LIFT TRUCK WITH SYNCHRONIZED VARIABLE TRAVELLING AND LIFTING SURFACES

This application is a continuation of application Ser. No. 202,828, filed Oct. 31, 1980, now abandoned.

BACKGROUND OF THE INVENTION

The invention relates to a fork-lift truck whose travelling surface and pick-up surface can be varied in a synchronized way.

At the present time, most industries (food, textile, metallurgical . . . ) use, for handling the parts resulting from manufacture, trays which facilitate considerably the transport and the storage of these parts as well as feeding the work stations.

These trays have very different formats and, for high capacity and high tonnage trays, they are constructed so as to be handled by means of motorized fork-lift trucks. On the contrary, for small-scale handling, which covers loads varying from 30 kg to 500 kg, there only exist trucks adapted to a single tray format which requires having at one's disposal several trucks of different formats. Furthermore, these trucks are constructed solely to lift the tray off the ground so as to move it and they do not have the facility of raising them for stacking them, putting them on shelves or placing them at a suitable height for feeding work stations. For their rigidity, these trays are constructed with external reliefs situated on the upper edge and also comprise passages for grasping with the hands so as to handle them and stack them, which compels the user to make physical efforts under poor conditions.

SUMMARY OF THE INVENTION

The invention aims at remedying the above disadvantages by providing a truck whose design allows a single person to pick up simply and without effort relatively heavy trays of different formats, and then to be able not only to move them but also to raise them within the lifting limits provided for the truck.

This truck is further very useful for the handling and the transport by lorry of objects having very varied forms (household appliances, furniture etc. . . . ), and it may be motorized by means of an electric motor or a thermal motor.

The truck of the invention is characterized by the fact that its opening surface can be varied at will, and it is obtained by a mobile assembly of two similar and totally independent elements ensuring the function of travelling over the ground and the taking up and lifting function. Each element is formed by a vertical mast integral at its lower end with a side-frame supporting the travelling means and along which a support for a lifting arm may slide. The vertical mast and the sliding support each carry horizontal cross pieces designed so that, when the two elements are assembled so as to form the truck, the cross pieces carried by one of the elements (which we will call the mobile element of the truck) engage by sliding inside the cross pieces carried by the other element (called the fixed element of the truck). Thus it can be seen that, by causing the mobile element of the truck to slide with respect to the fixed element, the travelling surface and the picking up surface of the truck can be varied in a synchronized way so as to adapt it to the particular format of the load to be picked up.

To ensure proper rigidity of the cross pieces when the truck is in a fairly wide apart position, a triple telescopic cross piece system is provided in which, inside the internal mobile cross piece, there is disposed freely sliding in additional cross piece. This additional cross piece, which is automatically positioned in the middle of the assembly formed by the external cross piece and the internal cross piece in cooperation through the action of a spring system, ensures perfect rigidity of this assembly.

The perfect synchronization of the sliding movement of the cross pieces is advantageously obtained by connecting, through a pinion and endless chain system, the sliding controls for the cross pieces supported by the masts of the truck and formed by a pinion carried by each fixed cross piece element and meshing with a rack carried by the corresponding mobile cross piece element.

So as to obtain excellent picking up of any object, the invention provides the lifting arms with removable sliding pieces in the form of vertical metal sheets whose lower ends present an inward right-angle bend for picking up, down to a level flush with the ground, objects having very reduced engagement surfaces.

According to the invention, raising of the fork support of the truck may be obtained by a central hydraulic jack whose mobile rod acts through a pulley on a synthetic material strap one end of which is connected to a sliding cross piece of the fork support and whose other end is connected to the chassis of the truck. Since this cross piece comprises the clearances required for allowing easy sliding of the tubes one in the other, it will be readily understood that it might be subjected to bending under the effect of the load applied to the forks, which, when the cross piece is completely extended, would cause deformation of the parallelism of the slides of the fork support. To avoid this disadvantage, the ends of this cross piece are hingedly mounted on the fork support whereas the other cross piece connecting the fork supports, which is secured to these supports, ensures the rigid assembly of these supports with perfect squaring.

The hydraulic lifting system may be variable in speed and to this end, in accordance with the invention, the piston of the control pump of the jack is connected to an actuating lever in the form of a pedal designed so that the user can vary the distance between the pivoting shaft of the actuating lever and the shaft by which the piston is hinged to this lever, thus allowing, according to the conditions of use of the truck, rapid lifting of the empty or lightly loaded truck to be obtained for example and slow lifting but with a minimum effort when the truck is at its maximum load.

Still in accordance with the invention, the hydraulic lifting device may comprise two lateral jacks, the mobile rod of each cooperating through a pinion with a chain fixed, on the one hand, to a cross piece of the fork support and, on the other hand, to the chassis of the truck. To avoid an uneven distribution of the load on the two forks, when the truck is opened wide, from causing a pressure difference between the two jacks prejudicial to proper sliding of the support, the invention provides for synchronizing the action of the two jacks by interlocking the pinions by means of a telescopic universal joint.

DESCRIPTION OF THE DRAWINGS

So that the invention may be well understood, several preferred embodiments will be described hereafter with reference to the accompanying schematical drawings in which:

FIG. 4 is a front view of an extendable truck with hydraulic lifting system according to a second embodiment of the invention;

FIG. 5 is a partial side view of the truck of FIG. 4;

FIG. 6 is a top view showing the mechanical control of the hydraulic lifting system;

DESCRIPTION OF THE PREFERRED EMBODIMENTS

Figure 1:
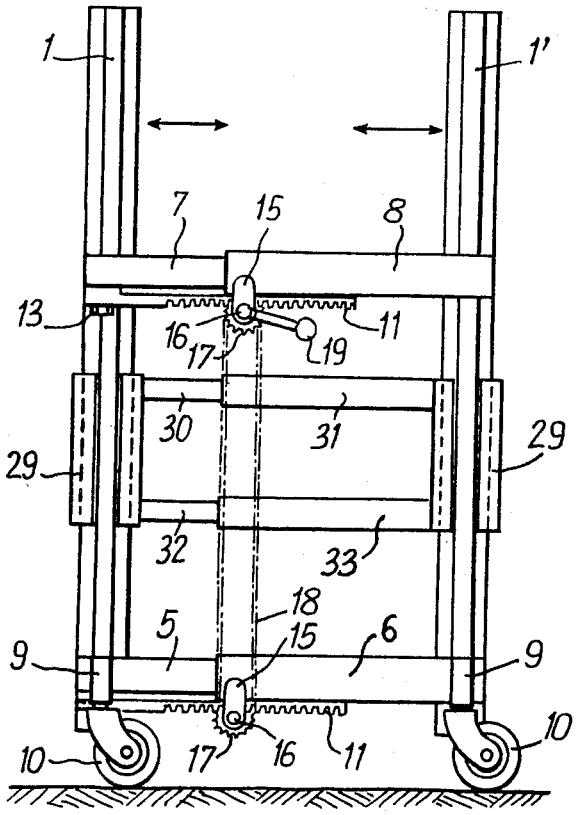
FIG. 1 is an elevational view of the rear of a truck according to a first embodiment of the invention.
Figure 2:
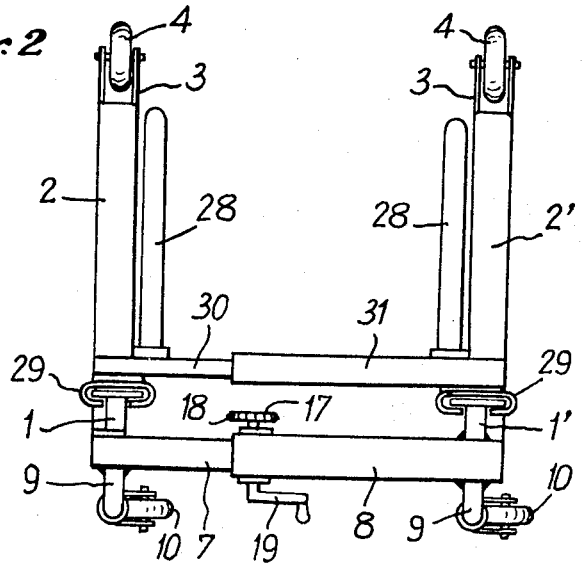
FIG. 2 is a top view of the truck of FIG. 1.

The variable surface fork-lift truck shown in FIGS. 1 and 2 is formed from two elements (right and left) each comprising a mast 1,1', welded vertically to a side-frame 2,2' which has at its end a fork-joint 3 receiving a freely rotating wheel 4 (see FIG. 2). On mast 1 are fixed at different levels, by their end, parallel cross pieces 5,7 for example having a square section. On mast 1' are fixed, at corresponding heights, parallel cross pieces 6,8 inside which cross pieces 5,7 are intended to slide. On each lower cross piece 5,6 there is fixed a support 9 on which there is mounted a pivoting wheel 10.

The extending and retracting movement of the two elements forming the truck is provided by simultaneous sliding of cross pieces 5,6, on the one hand, and of cross pieces 7,8 on the other. This movement, which must take place freely and without strain with perfect parallelism of the two truck elements is obtained by fixing, by means of screws 13, on the end of each of the lower cross pieces 5,7, a rack 11 designed to be able to slide against the lower face of the corresponding external cross piece 6,8.

Figure 3:
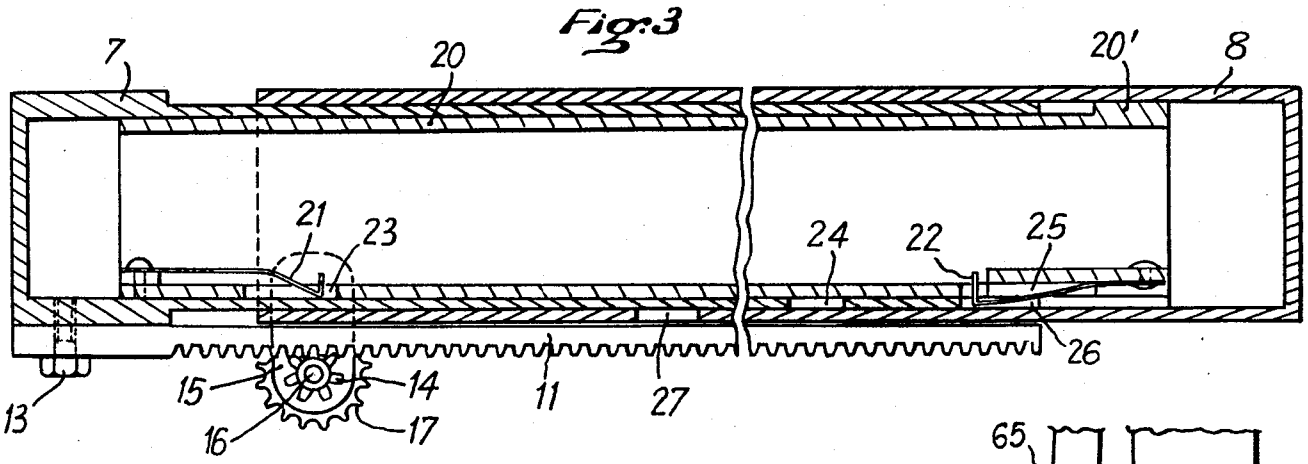
FIG. 3 is an enlarged view in longitudinal section of a connection with three sliding cross pieces.

As can be seen in the detail view of FIG. 3, movement of each rack 11 is provided by means of a pinion 14 which is engageable with rack 11 and which is mounted freely rotating on a bearing 15 in the form of a fork-joint integral with the corresponding external cross piece 6,8. Synchronization of the movements of the two mobile inner cross pieces 5,7 relative to the fixed external cross pieces 6,8 is obtained by means of an endless chain 18 which travels over two gear pinions 17 mounted on the same shaft 16 as pinions 14. A handle 19, secured to the shaft 16 of the upper gear pinion 14, thus allows variation of the width of the truck to be controlled so as to adapt it to the load to be handled.

Advantageously, a sliding cross piece structure is provided ensuring perfect rigidity of these cross pieces, even when the truck is in its widest apart position for taking up objects of great width. To this end, a system with three telescopic cross pieces is constructed such as shown in FIG. 3 and in which an additional cross piece 20 is mounted so as to be able to slide in the inner cross piece 7. To compensate for the sectional difference with the external cross piece 8, the additional cross piece 20 has at one end an external relief 20'. For this system to be efficient, it is necessary, whatever the amplitude of the outgoing movement of the inner cross piece 7, for the additional cross piece 20 to take up its position in the middle of the assembly formed by the external 8 and internal 7 cross pieces, and it must not then jam in the external cross piece 8 or remain fixed in the internal cross piece 7. To this end, a device for automatically adjusting the position of the additional cross piece 20 is provided, the purpose of this device, when the inner cross piece 7 extends, being to automatically take along therewith the additional cross piece 20, and to release this latter whereas the inner cross piece 7 continues its movement.

The adjusting device comprises two springs 21,22 each fixed to one end of the internal wall of the additional cross piece 20. Spring 21, located on the internal cross piece 7 side, bears resiliently, through a notch 23 of cross piece 20, on the wall of internal cross piece 7 and is intended to be engaged, when cross piece 7 extends, in a notch 24 thereof thus firmly interlocking cross pieces 7 and 20 and ensuring the automatic extension of this latter. Spring 22 bears resiliently, through a notch 25 of the additional cross piece 20, on the internal cross piece 7 and engages in a notch 26 formed at the end of cross piece 7 so as to extend, after a certain length of travel of the interlocked cross pieces 7 and 20, into a notch 27 of the external cross piece 8 which immobilizes the additional cross piece 20.

A sliding support is provided for receiving, in a fixed or removable way, forks 28 for taking up and lifting objects to be handled. This support is formed by two identical slides 29 designed so as to slide freely on masts 1,1' and which, in the embodiment of FIGS. 1 and 2, are made from T section tubing. Slides 29 are connected together, as an extendable assembly, by upper 30,31 and lower 32,33 sliding cross pieces whose operation is identical to cross pieces 5,6,7,8.

In FIGS. 4 and 5 there is shown a variation of the fork-lift truck of the invention with a hydraulic lifting device. To the fixed upper cross piece 31 there is secured, by means of a fork joint 34 integral with the cross piece, one end of a synthetic material strap 35 passing over a pulley 36 which is freely rotatably mounted in a fork joint 37 integral with the free end of a piston rod 38 moving inside jack body 39. The opposite end of strap 35 is fixed to a fork joint 40 integral with the fixed cross piece 8. The ends of the lower sliding cross piece 32,33 are fixed by welding to the corresponding slide 29, whereas the ends of the upper sliding cross pieces 30, 31 are hinged by a fork joint 41 and a pin 42 to slides 29. With this hinged assembly, although the pull of the strap 35 causes a slight bending of cross piece 30,31, this bending movement is not reflected on slides 29 which remain perfectly parallel to each other and are thus not impeded in their sliding movement along masts 1,1'.

Pick-up forks 28 are constructed in the form of right-angled brackets with arms of unequal lengths and are designed so as to be removably fixed on shaped parts 43 independent of each other and fixed by welding to slides 29. There is shown in FIG. 4, with a continuous line and a broken line, two possible positions for each fork 28. The shortest arm of each fork 28 is designed so as to be fixed by hooking on to the corresponding section 43 through the appropriate shape of its upper end 44. The angle of fork 28 comprises at its base a longitudinal projection 45 for locking the fork by engagement thereof under cross piece 33. Forks 28 are formed with a square or rectangular profile, so as to adapt therein removable elements formed for example by a tube 46 which slidingly engages on fork 28 and with which there is assembled a vertical metal sheet 47 comprising at its base a right-angled bend 48. It will be readily understood that, through the possibility of extension of the truck and by means of the right-angled bend 48 of metal sheet 47, all kinds of objects such as handling trays, household appliances, furniture etc. . . . may be picked up from the ground without requiring previous lifting.

There will now be described the hydraulic lifting system for supports 29 of forks 28, which comprises a manual reciprocating pump controlling hydraulic jack 39. The pump piston (not shown) is immersed in the reservoir 49 of hydraulic fluid and its rod 50 is connected by a shaft 51 to the end of two links 52 whose opposite ends 53 in the form of fork joints are hinged by shafts 54 on each side of a double lever 55. A helical spring (not shown) is mounted inside reservoir 49, so as to be able to slide along rod 50, stops being provided for limiting the travel of the piston at its high point inside the reservoir, so as to allow its immediate motor action.

At the end of double lever 55 there is hinged, about a longitudinal shaft 56, an actuating lever 57 having at its end a rounded surface 58 which forms a pedal actuatable by the foot of the user. Actuating lever 57, in the position of use, comes to bear through a stop 59 on the base 60 of the edges of double lever 55, as can be seen in FIG. 6, whereas this lever 57 may be retracted in the vertical position (position shown with a broken line in FIG. 5) and be maintained in this retracted position by a spring (not shown). Double lever 55 is hinged to a shaft 61 mounted in a bore provided in a piece 62 welded to reservoir 49. Each arm of the double lever 55 has an oblong opening 63 whose base comprises notches 64 (three in number in FIG. 5) intended to selectively receive the corresponding rotational shaft 61.

The operation of the hydraulic lifting device can be readily understood from the above description. With the double lever 55 positioned so that shafts 61 engage in the facing notches 64 of the two arms of this lever, the user brings the actuating lever 57 into its position of use where the stop 59 of this lever bears on lever 55. By pressing with his foot on the pedal 58, the user causes double lever 55 to pivot downwardly about shafts 61 and, through links 52, actuates the piston to deliver the hydraulic fluid from reservoir 49 to jack 39 while ensuring lifting of rod 38 and so of forks 28. The return of the actuating lever to its high position is provided by the spring (not shown) mounted on the piston rod 50 inside reservoir 49. The user may modify the lifting speed of the supports 29 of forks 28 by modifying the disposition of shafts 61 inside notches 64, i.e. by varying the distance between shafts 61 and shafts 54. The movement of the double lever 58 for modifying the disposition of shafts 61 with respect to notches 64 is simply obtained by raising lever 57 and moving it longitudinally.

Figure 7:
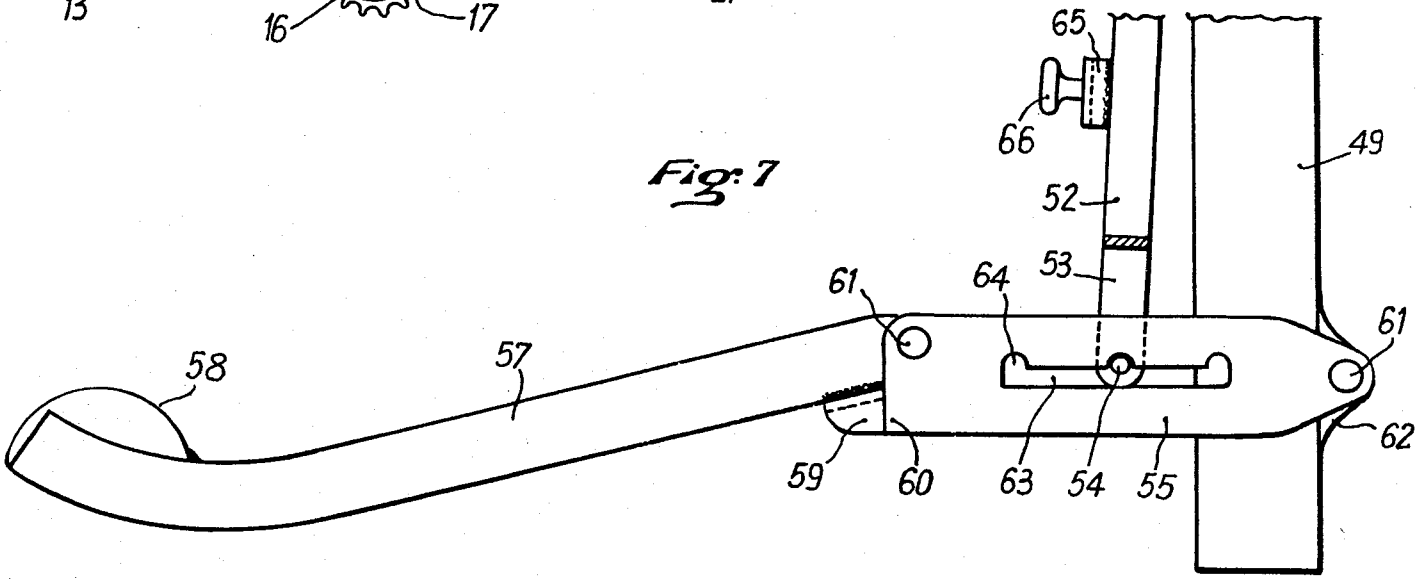
FIG. 7 is a side view of a variation of the mechanical hydraulic lifting control.

According to a variation of the mechanical system for changing the lifting speed shown in FIG. 7, double lever 55 can no longer move longitudinally with respect to hinge shaft 61 and it is the hinge shaft 54 of each link 52 which may be moved along the oblong slot 63 of the corresponding arm of double lever 55, to engage in one of the notches 64 provided this time at the upper part of slot 63. So as to allow easy manual control of the speed change and so a synchronized movement of links 52, these latter are connected to each other by a bar 65 in the form of a stirrup which has in its central part a handle 66.

Figure 9:
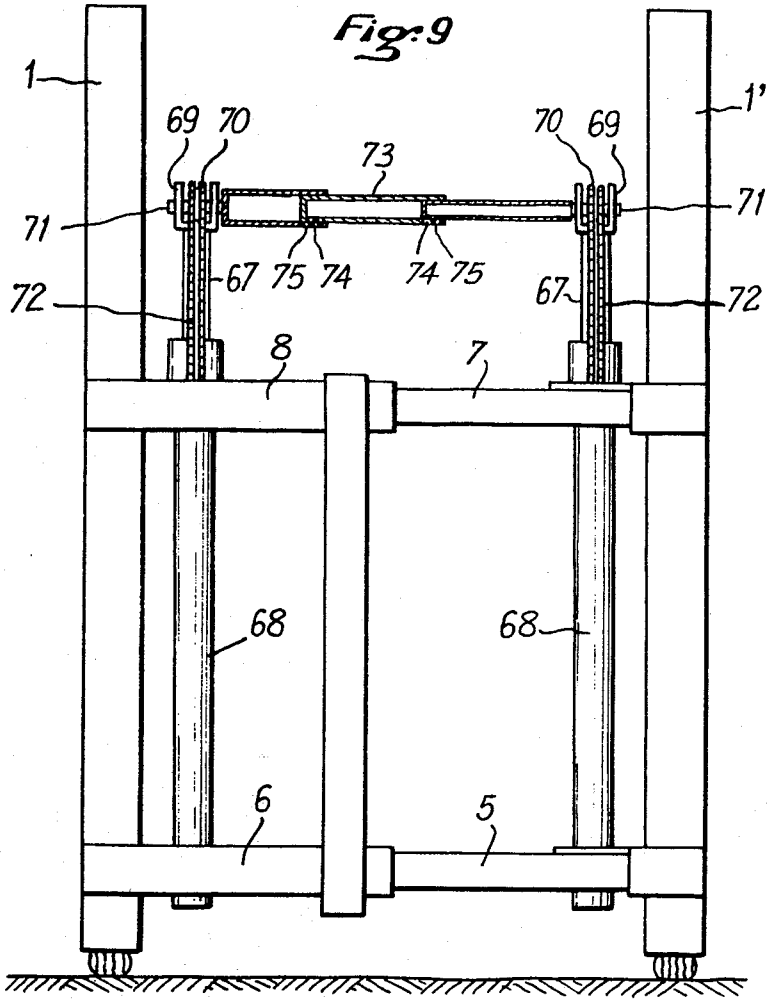
FIGS. 8 and 9 are views, respectively from the side and the rear, of a truck with an hydraulic two-jack lifting system according to a third embodiment of the invention.
Figure 8:
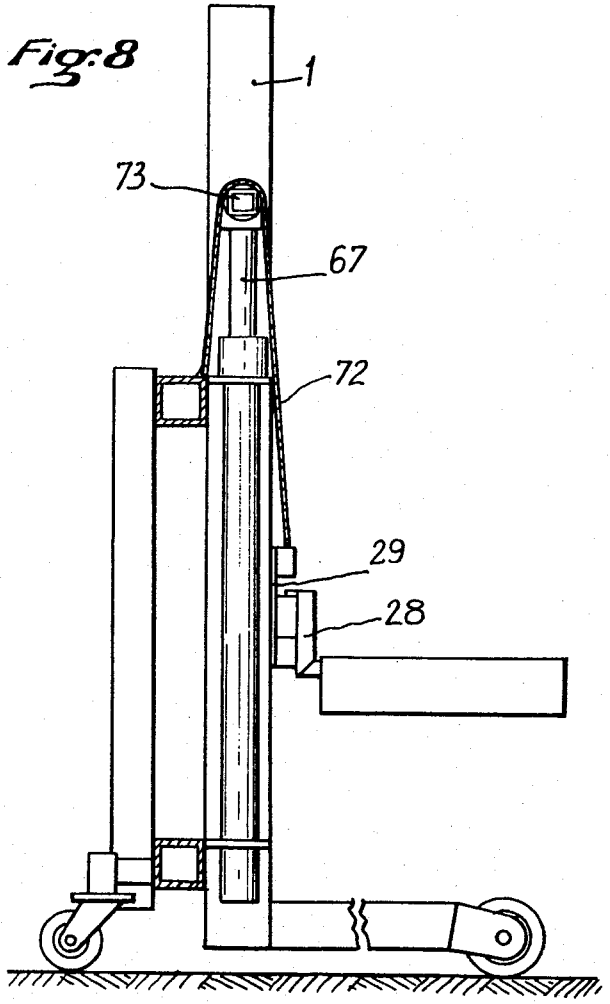

To raise loads of great width and substantial weight, the truck of the invention may be equipped with a hydraulic lifting system with two lateral jacks such as shown in FIGS. 8 and 9. A synchronized hydraulic lifting device is used in which each rod 67 of jack 68 bears at its free end a fork joint 69 in which can freely rotate a pinion 70 rigid with a rotation shaft 71. On each pinion 70 runs a lifting chain 72 one end of which is connected to the fork support 29 and the other end of which is secured to the chassis of the truck.

To ensure the synchronized rotation of the two pinions 70, their rotation shafts 71 are rigidly interconnected by means of a telescopic universal joint 73, this latter being realized as two or more sliding pieces (three in the form of embodiment shown at FIGS. 8 and 9). In order to prevent one of the sliding pieces to completely come out from the external piece along which it slides, each inner slide piece carries a spring 74 adapted to automatically engage an opening 75 provided at the end of each external sliding piece.

This device allows to obtain a perfectly synchronized lifting movement of the two jacks, whatever the load applied to each jack, by balancing the fluid pressure within each jack.

What is claimed is:

1. A fork-lift truck with synchronized variable travelling and lifting surfaces, comprising two substantially symmetrical and independent sub-assemblies, each sub-assembly comprising a vertical mast, a horizontal side-frame integral with said mast, each sub-assembly including a pair of wheels, one of said wheels being rotatably secured to said sub-assembly adjacent said mast and extending therebelow and the other wheel being rotatably secured to said sub-assembly at the end of said side-frame remote from said mast and extending therebelow, two parallel cross pieces disposed at different heights integral with said mast and extending normal thereto, and a support for a lifting arm slidable along said mast and having at least one cross piece, the cross pieces of one of said sub-assemblies being slidable inside corresponding cross pieces of the other sub-assembly thus allowing easy adaptation of the width of the truck to the load to be taken up, control means provided for a synchronized control of the sliding of said cross pieces, and housed inside the inner and outer cross piece an additional cross piece adapted to freely slide for ensuring perfect rigidity even in case of maximum extension.

2. The truck as claimed in claim 1 wherein the additional cross piece has at one end an external relief for compensating the sectional difference between the external cross piece and the additional cross piece.

3. The truck as claimed in claim 1 or claim 2 wherein two springs supported by the internal wall of the additional cross piece are intended, one to engage in a notch of the inner cross piece so as to ensure automatically the extension of the additional cross piece with the inner cross piece, and the other to engage in a notch of the fixed external cross piece so as to limit the extension of the additional cross piece and to position this latter in the center of the assembly formed by the external cross piece and the internal cross piece.

4. The truck as claimed in claim 1 wherein said control means are formed by a rack integral with each inner cross piece carried by the mast of one of the two truck elements and cooperating with a toothed pinion mounted so as to rotate on the corresponding external cross piece of the mast of the other truck element, the toothed pinions fitted to the two external cross pieces being connected together so as to allow their synchronized control by means of an actuating member.

5. The truck as claimed in claim 1 wherein the lifting arms slidingly receive interchangeable pick-up elements in the form of metal sheets positioned inside the truck and whose bases situated at ground level have facing right-angled bends, allowing the most diverse objects to be picked up from the ground without previous lifting.

* * * * *